US011338334B2

(12) United States Patent
Conway

(10) Patent No.: US 11,338,334 B2
(45) Date of Patent: May 24, 2022

(54) VEHICLE MOUNTED GARBAGE BIN CLEANING SYSTEM INCLUDING POWER TAKEOFF

(71) Applicant: SPARKLING BINS, LLC, Doral, FL (US)

(72) Inventor: John Conway, Miami, FL (US)

(73) Assignee: SPARKLING BINS, LLC, Doral, FL (US)

( * ) Notice: Subject to any disclaimer, the term of this patent is extended or adjusted under 35 U.S.C. 154(b) by 0 days.

(21) Appl. No.: 17/534,673

(22) Filed: Nov. 24, 2021

(65) Prior Publication Data

US 2022/0080477 A1 Mar. 17, 2022

Related U.S. Application Data

(63) Continuation-in-part of application No. 17/037,041, filed on Sep. 29, 2020, now Pat. No. 11,185,899, which is a continuation of application No. 16/883,788, filed on May 26, 2020, now Pat. No. 10,864,561, which is a continuation of application No. 16/428,516, filed on May 31, 2019, now Pat. No. 10,661,317, which is a continuation-in-part of application No. 16/235,577, filed on Dec. 28, 2018, now Pat. No. 10,926,949.

(51) Int. Cl.

| | |
|---|---|
| ***B08B 9/093*** | (2006.01) |
| ***B65F 7/00*** | (2006.01) |
| ***B08B 9/08*** | (2006.01) |

(52) U.S. Cl.

CPC ..... *B08B 9/0936* (2013.01); *B08B 9/0826* (2013.01); *B08B 9/0933* (2013.01); *B65F 7/005* (2013.01); *B08B 2203/0264* (2013.01); *B08B 2209/08* (2013.01)

(58) Field of Classification Search

CPC ..... B08B 9/08; B08B 9/0804; B08B 9/0813; B08B 9/0821; B08B 9/0826; B08B 9/093; B08B 9/0933; B08B 9/0936; B08B 9/20; B08B 9/205; B08B 9/28; B08B 9/34; B08B 9/42; B08B 2209/08; B65F 7/00; B65F 7/005; B65F 2003/0223; B65F 2003/0226; B65F 2003/023; B65F 2003/0233

See application file for complete search history.

(56) References Cited

U.S. PATENT DOCUMENTS

| | | | | |
|---|---|---|---|---|
| 3,372,875 A * | 3/1968 | Torrey | B65F 7/005 | 239/289 |
| 2010/0170537 A1* | 7/2010 | Gingras | B65F 7/005 | 417/393 |
| 2012/0125364 A1* | 5/2012 | Wiley | B08B 9/0936 | 134/133 |

* cited by examiner

*Primary Examiner* — David G Cormier
(74) *Attorney, Agent, or Firm* — Mark Terry

(57) ABSTRACT

A vehicle mounted garbage bin cleaning system including power takeoff includes a pair of arms configured for lifting a garbage bin, the pair of arms rotatably coupled to a mount on the vehicle, a hopper configured for accepting the garbage bin when the pair of arms lifts the garbage bin into the hopper, at least one spray rod extending upwards from the hopper, said spray rod including a water nozzle, wherein when the pair of arms lifts the garbage bin into the hopper, the spray rod is situated within the garbage bin, a hydraulic pump mechanically coupled with a transmission of the vehicle, such that the transmission drives the hydraulic pump, a pressure washer pump mechanically coupled to the hydraulic pump, the spray rod is fluidically coupled with the pressure washer pump.

18 Claims, 11 Drawing Sheets

VEHICLE MOUNTED GARBAGE BIN CLEANING SYSTEM INCLUDING POWER TAKEOFF

CROSS-REFERENCE TO RELATED APPLICATIONS

This patent application is a continuation in part of, and claims priority to, patent application Ser. No. 17/037,041 filed Sep. 29, 2020 and titled "Vehicle Mounted Garbage Bin Cleaning System Including Power Takeoff and Driveshaft", which is a continuation of, and claims priority to, patent application Ser. No. 16/883,788 filed May 26, 2020 and titled "Vehicle Mounted Garbage Bin Cleaning System Including Power Takeoff", which is a continuation of, and claims priority to, patent application Ser. No. 16/428,516 filed May 31, 2019 and titled "Vehicle Mounted Garbage Bin Cleaning System Including Power Takeoff", which is a continuation in part of, and claims priority to, patent application Ser. No. 16/235,577 filed Dec. 28, 2018 and titled "Vehicle Mounted Garbage Cleaning System." The subject matter of patent application Ser. Nos. 17/037,041, 16/883,788, 16/428,516, and 16/235,577 are hereby incorporated by reference in their entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to garbage bin cleaning systems and, more specifically, to vehicle mounted garbage bin cleaning systems for thoroughly cleaning and deodorizing garbage bins in a highly automated manner.

BACKGROUND

Sanitation is a critical feature in any society, as it is a requirement for providing desirable living conditions. Sanitation being improperly performed can and does lead to sickness and even death on a massive scale. To this end, the disposal of garbage from commercial establishments, residential homes and apartment houses is generally handled by garbage trucks equipped to handle garbage bins. These trucks have the capability of lifting the bins and dumping the contents thereof into a compactor from where the compacted trash is pushed by a ram into the back of the truck for dumping. Particularly in the case of restaurants and apartment houses where the trash contains a considerable amount of organic material, the garbage bins may become unpleasantly odorous, even after having been emptied, and can present a health problem.

The current solutions for washing and disinfecting garbage bins are largely unacceptable. Manually washing and disinfecting garbage bins can be time consuming and tedious for a person to perform, as well a labor intensive. Automated processes may be employed, such as through the use of tank trucks equipped with a hoisting device and a separate pump unit adapted to provide water jets for sprinkling the interior walls of the garbage bin, with the bin being suspended from the hoisting device. The automated processes, however, are usually limited in scope as the tank truck and hoisting device are usually limited to garbage bins of a particular size, thereby leaving a large amount of garbage bins of differing sizes unattended. Conventional automated processes for washing and disinfecting garbage bins can also leave many interior areas of a garbage bin being untouched, with a large proportion of the dirt stubbornly adhering on the garbage bin walls. The known automated processes may also use exorbitant amounts of water per garbage bin, thereby resulting in large amounts of water waste. Conventional automated processes for washing and disinfecting garbage bins may further cause runoff of the wastewater into the environment, which can be damaging.

Furthermore, some of the conventional automated processes for washing and disinfecting garbage bins are inefficient, as they require one or more separate gas engines to power the water pumps that provide pressurized water to the spraying system. The requirement of additional engines introduces inefficiencies into the system, including additional maintenance requirements for the additional engines, additional fuels costs, additional points of failure that increase downtime of the system, and additional repairs. These inefficiencies increases overall cost and time requirements for said conventional automated processes and are therefore disadvantageous.

Therefore, a need exists for improvements over the prior art, and more particularly for improved systems and apparatuses for quickly and efficiently performing a proper cleaning and disinfecting regimen for garbage bins.

SUMMARY

A vehicle mounted garbage bin cleaning system including power takeoff is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the vehicle mounted garbage bin cleaning system including power takeoff includes a pair of arms configured for lifting a garbage bin, the pair of arms rotatably coupled to a mount on the vehicle, a hopper configured for accepting the garbage bin when the pair of arms lifts the garbage bin into the hopper, at least one spray rod extending upwards from the hopper, said spray rod including at least one high-pressure, rotating water nozzle that sprays a water jet, wherein when the pair of arms lifts the garbage bin into the hopper, the at least one spray rod is situated within the garbage bin, and a power takeoff driven pressure washing system comprising: 1) a hydraulic pump mechanically coupled with a transmission of the vehicle, such that the transmission drives the hydraulic pump; 2) a pressure washer pump hydraulically coupled to the hydraulic pump such that the hydraulic pump drives the pressure washer pump; and 3) the at least one spray rod fluidically coupled with the pressure washer pump such that pressure washer pump provides pressurized water to the at least one spray rod.

In another embodiment, the vehicle mounted garbage bin cleaning system including power takeoff includes a pair of arms configured for lifting a garbage bin, the pair of arms rotatably coupled to a mount on the vehicle, a hopper configured for accepting the garbage bin when the pair of arms lifts the garbage bin into the hopper, at least two spray rods extending upwards from the hopper, each of said spray rods including at least one high-pressure, rotating water nozzle that sprays a water jet, wherein when the pair of arms lifts the garbage bin into the hopper, the at least one spray rod is situated within the garbage bin, and, a power takeoff driven pressure washing system comprising: 1) a first hydraulic pump mechanically coupled with a transmission of the vehicle, such that the transmission drives the first hydraulic pump; 2) a first pressure washer pump hydraulically coupled to the first hydraulic pump such that the first hydraulic pump drives the first pressure washer pump, and a second pressure washer pump hydraulically coupled to the first hydraulic pump such that the first hydraulic pump drives the second pressure washer pump; and 3) a first of the at least two spray rods fluidically coupled with the first pressure washer pump such that first pressure washer pump provides pressurized water to the first of the at least two spray rods, and a second of the at least two spray rods fluidically coupled with the second pressure washer pump such that second pressure washer pump provides pressurized water to the second of the at least two spray rods.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1A:
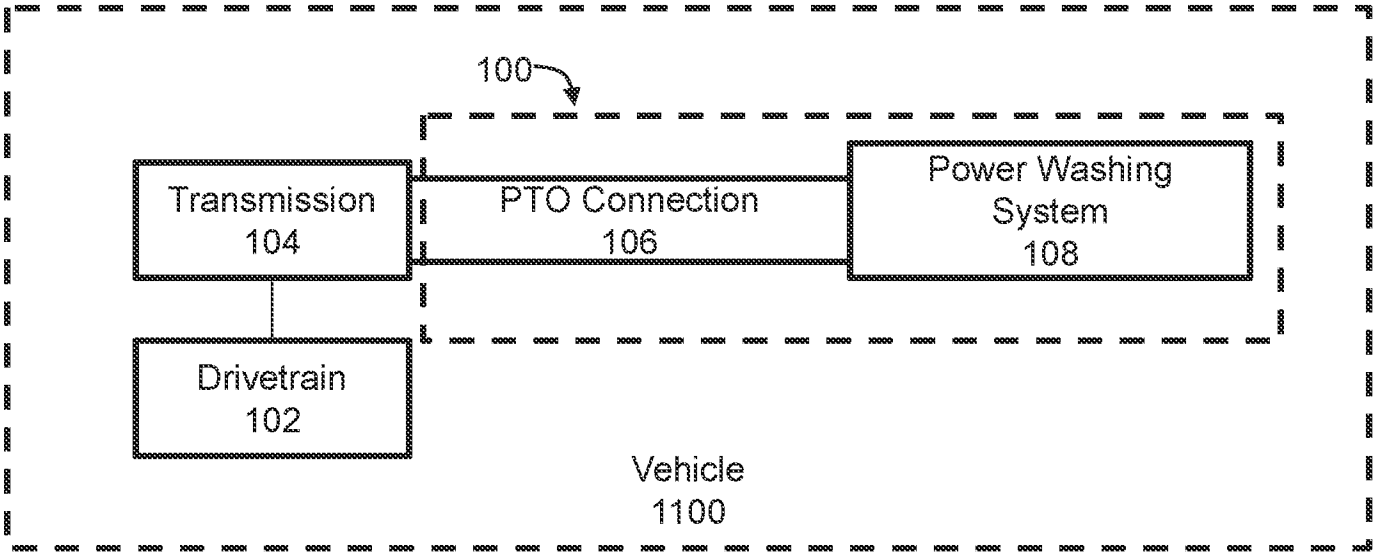
FIG. 1A is a drawing depicting a block diagram of the power takeoff driven pressure washing system of the vehicle-mounted garbage bin cleaning system, according to an example embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing a simple, cost-effective, and efficient vehicle-mounted garbage bin cleaning system configured for cleaning both large and small garbage bins, such as dumpsters and recycling bins. The claimed subject matter improves sanitation by allowing for larger number of large and small garbage bins to be cleaned at the curbside in smaller amounts of time, using a minimum of labor or manual user involvement. The claimed subject matter is particularly useful in the case of restaurants and apartment houses where the trash contains a considerable amount of organic material.

The claimed subject matter further improves over the prior art by providing an efficient system that does not require separate gas engines to power the water pumps that provide pressurized water to the spraying system. The elimination of additional engines removes inefficiencies such as additional maintenance requirements for the additional engines, additional fuels costs, additional points of failure that increase downtime of the system, and additional repairs. The removal of these inefficiencies decreases overall cost and time requirements for said claimed subject matter and are therefore advantageous.

The claimed subject matter also improves over the prior art by providing a system that allows for the pressure washing of more than one garbage bin at once. Conventional systems that use a separate or independent gas-powered pump only have enough power to operate one pressure washing pump at a time, and therefore only washing one garbage bin at a time. This limits the throughput of the system. By using a much more powerful power takeoff powered pressure washing system, the claimed subject matter allows for the pressure washing or more than one garbage bin at a time, thereby increasing the throughput of the system, in addition to increasing the volume of garbage bins that can be washed in a given period of time.

The claimed subject matter also improves over the prior art by using a simple automated process that is large in scope as garbage bins of a variety of sizes may be cleaned by the claimed system without requiring adapters or other adjustment of the system. The claimed subject matter also thoroughly washes and disinfects garbage bins without using exorbitant amounts of water per garbage bin, thereby resulting in aa reduction of water waste. The claimed subject matter also does no cause runoff of the wastewater into the environment, which is environmentally friendly. Furthermore, the claimed subject matter also efficiently cleans garbage bins at the curb and returns it to the curb, thereby increasing throughput and reducing physical labor.

FIG. 1A is a drawing depicting a block diagram of the power takeoff driven pressure washing system 100 of the vehicle-mounted garbage bin cleaning system 150, according to an example embodiment. FIG. 1A shows that the power takeoff driven pressure washing system 100 of the vehicle-mounted garbage bin cleaning system comprises a power washing system 108 connected to a transmission 104 of the vehicle 110 via a power takeoff connection 106. A power take-off or power takeoff (PTO) is any of several methods for taking power from a power source, such as a running engine, and transmitting it to an attached implement or separate machine. In a preferred embodiment, a splined drive shaft extends from the transmission 104 of the vehicle 1100, such as an industrial truck, and mating fittings on an attached power takeoff driven pressure washing system 100 (i.e., the PTO connection 106) allow the power takeoff driven pressure washing system 100 to be powered directly by the transmission of the engine.

The transmission 104 may have one or more locations which allow for the power takeoff connection to be mounted. The power takeoff may be engaged/disengaged using the main transmission clutch and/or a remote-control mechanism which operates on the power takeoff connection itself. An air valve may be used to engage the power takeoff connection, but a mechanical linkage, electric or hydraulic mechanism are also options. The power takeoff may connect directly to a hydraulic pump (described more fully below). This allows for transmission of mechanical force through the hydraulic fluid system to any location around the vehicle where the hydraulic fluid system will convert it back into rotary or linear mechanical force.

Figure 1B:
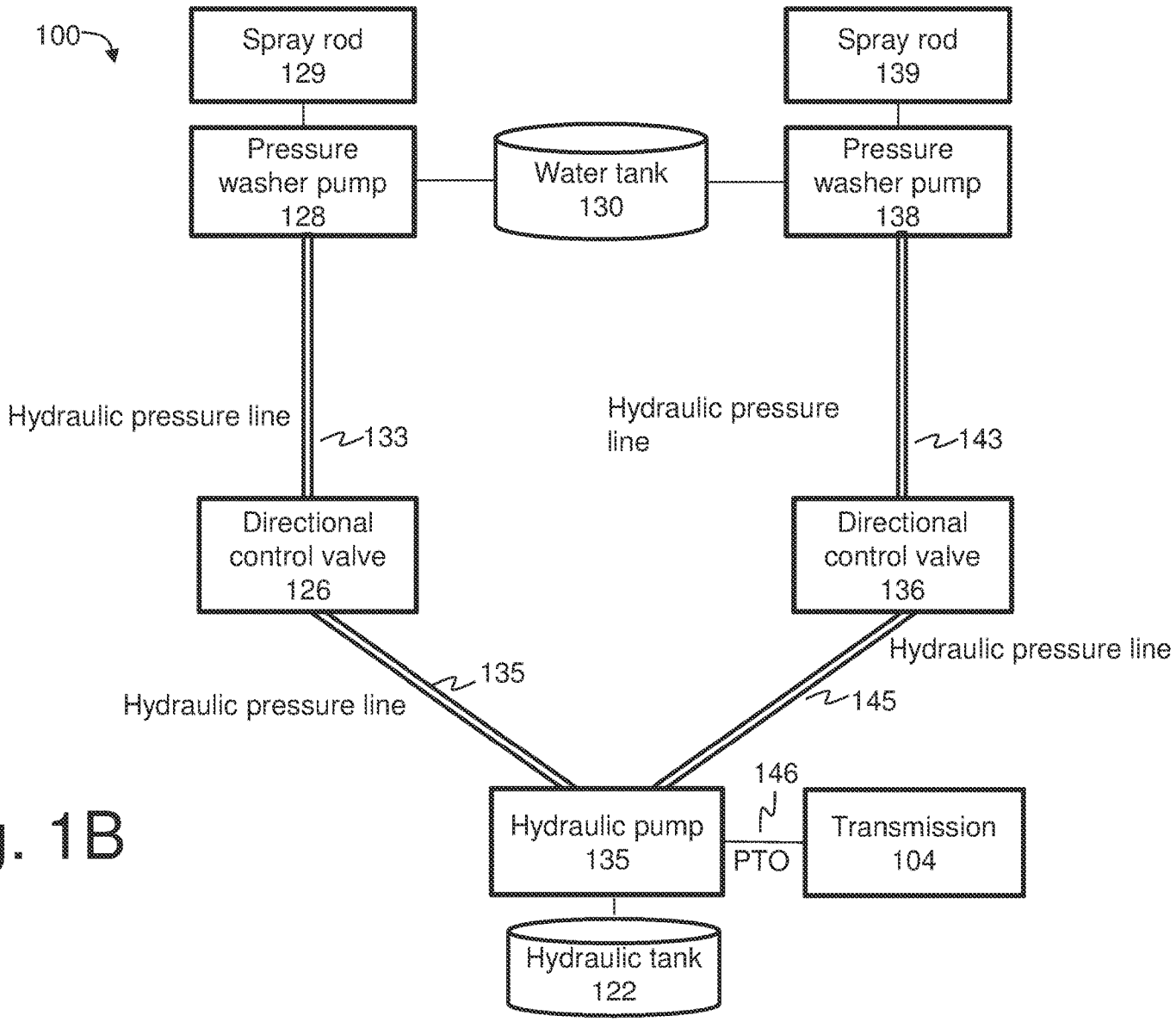
FIG. 1B is a drawing depicting a more detailed block diagram of the power takeoff driven pressure washing system of the vehicle-mounted garbage bin cleaning system, according to an example embodiment.

FIG. 1B is a drawing depicting a more detailed block diagram of the power takeoff driven pressure washing system 100 of the vehicle-mounted garbage bin cleaning system 150, according to an example embodiment. FIG. 1B shows that the power takeoff driven pressure washing system 100 includes at least a hydraulic pump 135 mechanically coupled to the transmission 104 via a PTO connection 146.

A hydraulic pump is a mechanical source of power that converts mechanical power into hydraulic energy (hydrostatic energy i.e., flow, pressure). It generates flow with enough power to overcome pressure induced by the load at the pump outlet. When a hydraulic pump operates, it creates a vacuum at the pump inlet, which forces liquid from the reservoir into the inlet line to the pump and by mechanical action delivers this liquid to the pump outlet and forces it into the hydraulic system. Hydraulic pumps are used in hydraulic drive systems and can be hydrostatic or hydrodynamic. The hydraulic pump may be a gear, rotary vane, screw, bent axis, inline axial piston, radial piston, or peristaltic pump.

The power takeoff driven pressure washing system 100 may be a hydraulic drive system, which is a quasi-hydrostatic drive or transmission system that uses pressurized hydraulic fluid to power hydraulic machinery. The term hydrostatic refers to the transfer of energy from pressure differences, not from the kinetic energy of the flow.

The power takeoff driven pressure washing system 100 may be an open hydraulic system. In this case, the hydraulic pump 135 draws oil from a reservoir or hydraulic tank 122 at atmospheric pressure. In case of a closed system, both sides of the hydraulic pump 135 can be at high pressure. In this case, the reservoir is often pressurized at higher pressure to boost pressure.

FIG. 1B further shows that the power takeoff driven pressure washing system 100 includes at least a first pressure washer pump 128 hydraulically coupled (via hydraulic pressure lines 133, 135) to the hydraulic pump 135, and optionally a second pressure washer pump 138 hydraulically coupled (via hydraulic pressure lines 143, 145) to the hydraulic pump 135. Hydraulic pressure lines are conduits (usually flexible) that hold and transport hydraulic fluid so as to hydraulically couple different hydraulic elements in a hydraulic circuit. Note that hydraulic pump 135 is specially configured to have the capacity to power both pressure washer pumps 128, 138. Note also that both pressure washer pumps 128, 138 are configured to be able to be powered directly by a hydraulic pump. Therefore, both pressure washer pumps 128, 138 are provided power by the controlled circulation of pressurized fluid, a motor that converts it into a mechanical output capable of doing the work of providing water pressure. Both pressure washer pumps 128, 138 must therefore include a hydraulic fluid input/output mechanism that allows for the circulation of hydraulic fluid within the pressure washer pumps 128, 138, wherein said circulation provides the power that each pump needs to provide water pressure for the spray rods.

FIG. 1B further shows that the power takeoff driven pressure washing system 100 includes at least a first directional control valve 126 situated between the first pressure washer pump 128 and the hydraulic pump 135, and optionally a second directional control valve 136 situated between the second pressure washer pump 138 and the hydraulic pump 135. A directional control valve is a hydraulic valve that allows hydraulic fluid flow into different paths from one or more sources. The directional control valve may consist of a spool inside a cylinder which is mechanically or electrically actuated. The position of the spool restricts or permits flow; thus, it controls the fluid flow. The directional control valves 126, 136 allows for the changing of direction of flow of hydraulic fluid into and out of the pressure washer pumps 128,138, so as to change the direction of operation of said pumps.

FIG. 1B further shows one, two or more spray rods 129 are fluidically coupled to the pressure washer pump 128, and one, two or more spray rods 139 are fluidically coupled to the pressure washer pump 138. A pressure washer pump is a water pump configured to pump water at high pressures suitable for pressure washing. A water pump is a device that moves water by mechanical action. The water pump may be a direct lift, positive displacement, impulse, velocity, gravity, steam, or valveless water pump. The water pump transports water from the reservoir or water tank 130 at high pressure to the spray heads.

FIG. 1B shows that the power takeoff driven pressure washing system 100 can be used to power more than one pressure washing pumps 128, 138 to expel high pressure water jets from more than one set of spray rods 129, 139. As a result, the power takeoff driven pressure washing system 100 can be used to pressure clean more than one garbage bins at once, using the multiple sets of spray rods 129, 139 at the same time. This feature increases the throughput of the system 100, in addition to increasing the volume of garbage bins that can be washed in a given period of time.

Figure 2:
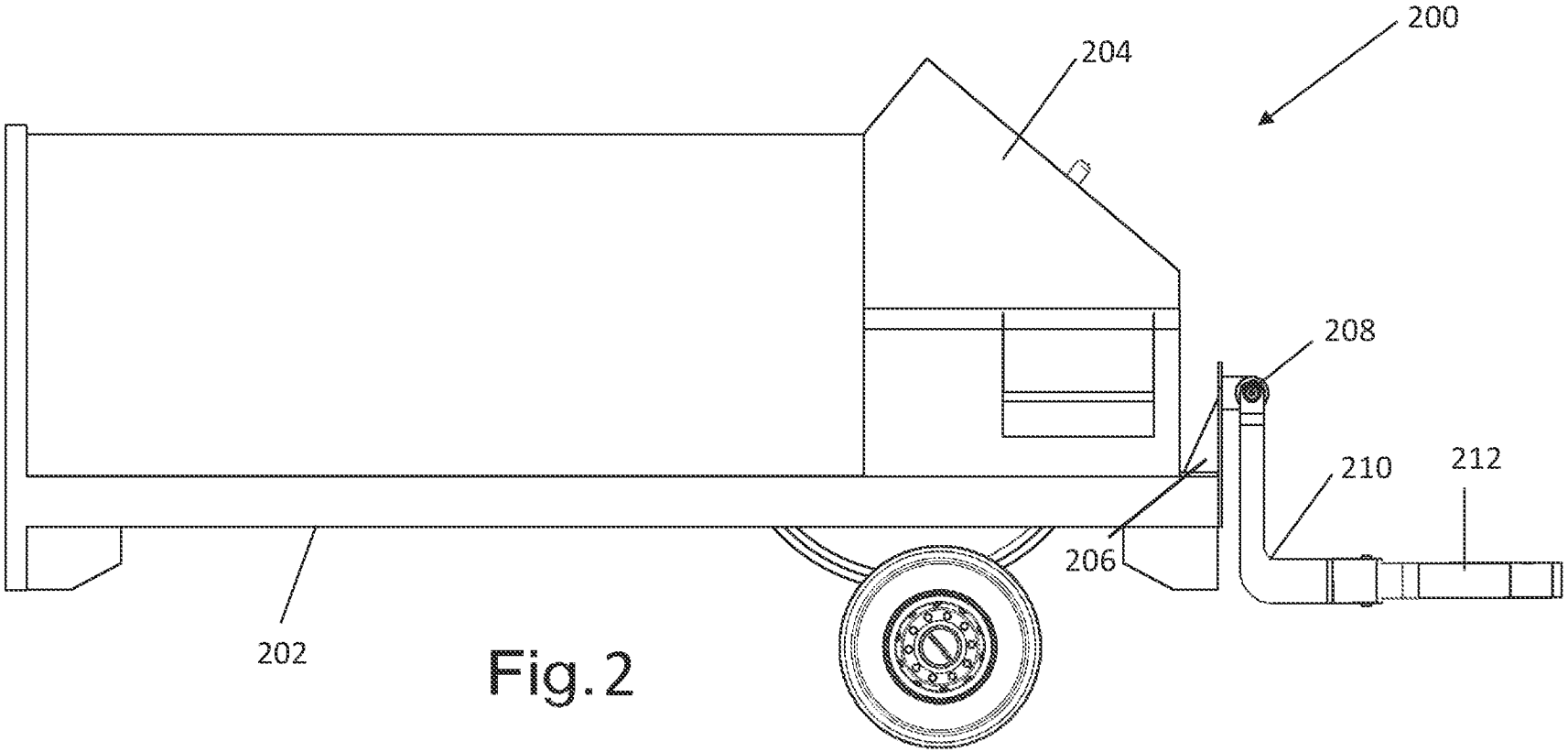
FIG. 2 is a drawing depicting a side view of another embodiment of the vehicle-mounted garbage bin cleaning system including power takeoff, showing two pairs of arms in the down position, according to an example embodiment.
Figure 3:
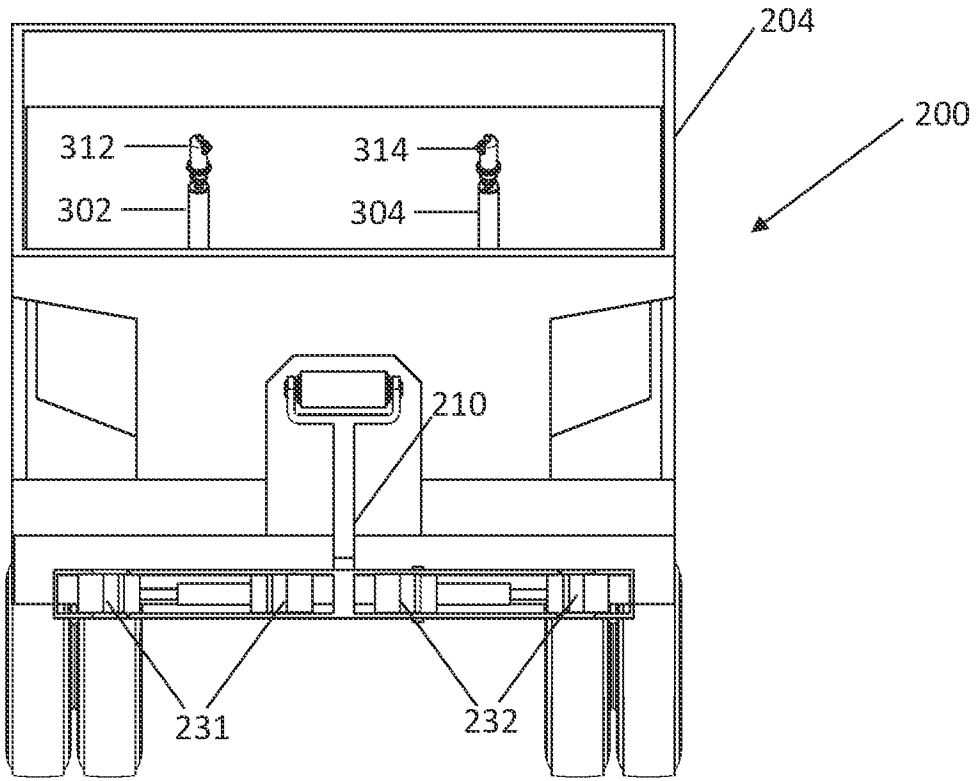
FIG. 3 is a drawing depicting a rear view of another embodiment of the vehicle-mounted garbage bin cleaning system including power takeoff, showing two pairs of arms in the down position, according to an example embodiment.
Figure 4:
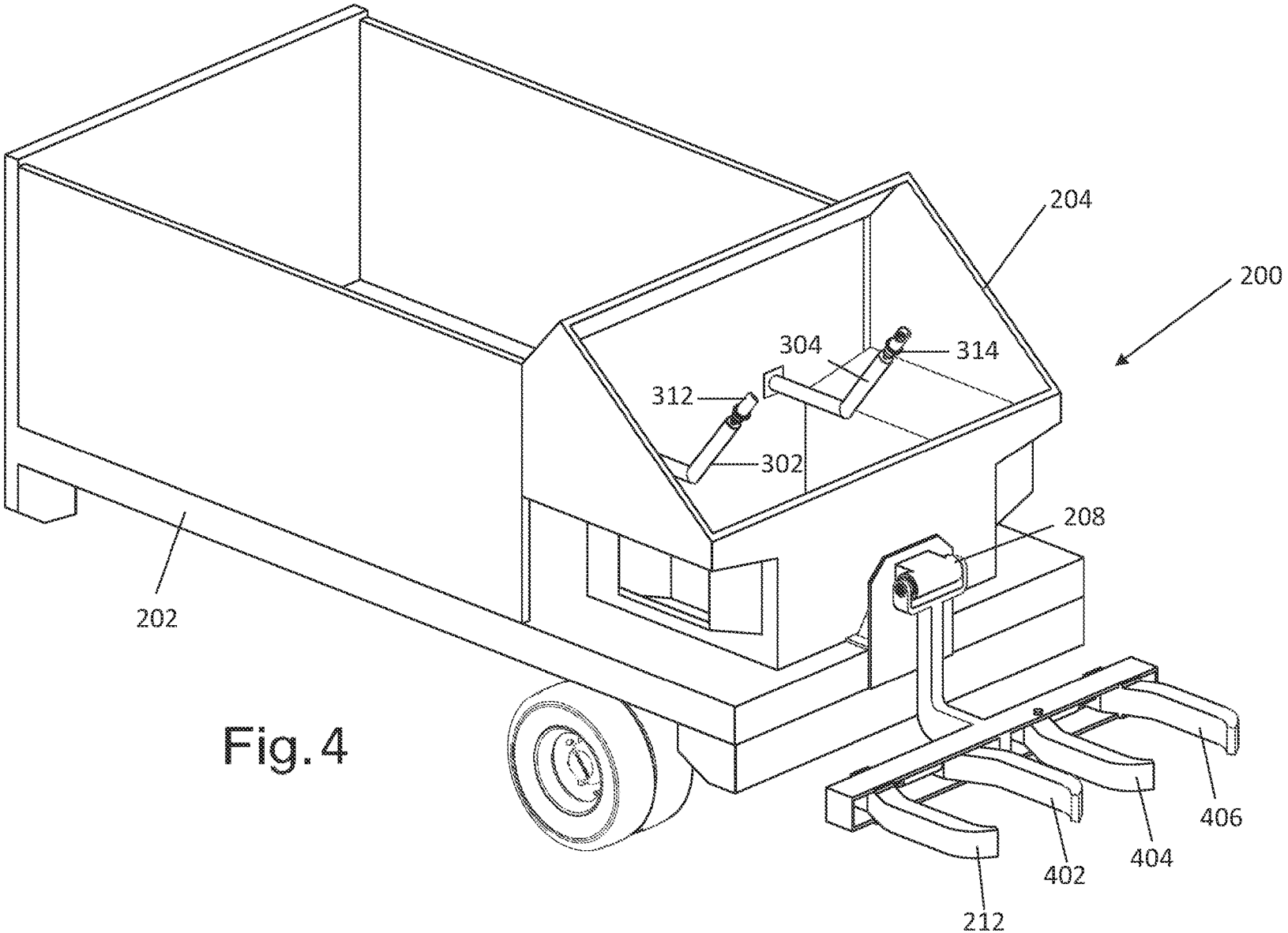
FIG. 4 is a drawing depicting a to perspective view of another embodiment of the vehicle-mounted garbage bin cleaning system including power takeoff, showing two pairs of arms in the down position, according to an example embodiment.

FIG. 2 is a drawing depicting a side view of another embodiment of the vehicle-mounted garbage bin cleaning system 200 including power takeoff, showing two pairs of arms 231, 232 in the down position, according to an example embodiment. FIG. 3 depicts a rear view of the vehicle-mounted garbage bin cleaning system 200 of FIG. 2, and FIG. 4 depicts a top perspective view of the vehicle-mounted garbage bin cleaning system 200 of FIG. 2. The vehicle-mounted garbage bin cleaning system 200 including power takeoff includes a mount 206, to which each of the two pairs of arms 231, 232 are independently attached. The vehicle-mounted garbage bin cleaning system 200 including power takeoff also includes a hopper 204. The two pairs of arms comprise a first pair of arms 231 and a second pair of arms 232. Each pair of arms may move simultaneously in sync (i.e., move from one position to another position). Alternatively, the first pair of arms 231 and the second pair of arms 232 may move independently from one another, such that one pair of arms may be activated (i.e., move from one position to another position) without activating the other pair. FIGS. 2-4 further show the spray heads 312, 314 located within the hopper 204.

The vehicle-mounted garbage bin cleaning system 200 may be coupled to the trailer element 202 of a vehicle, such as an industrial truck. The vehicle-mounted garbage bin cleaning system 200 includes two pairs of arms 231, 232 configured for lifting garbage bins, such as a trash can, recycling container, dumpster, rubbish bin, etc. Said dumpster may measure approximately 2, 4, 6, 8 or 10 cubic yards in volume, 70-85 inches wide, 45-95 inches high and 39-75 inches deep. Said bin may be a 35-95-gallon recycling bin and may measure approximately 35-95 gallons in volume, 20-29 inches wide, 38-45 inches high and 23-34 inches deep.

The two pairs of arms 231, 232 may be coupled to piston-activated levers that are themselves rotatably coupled to an L-shaped member 210 which is itself rotatably coupled to a mount 206 on the vehicle via a pivot point 208. The mount 206 may comprise one or more triangular elements located on either side of the trailer bed 202. The topmost vertex of the triangular elements comprise the pivot point 208. The mount 206 may also comprise further structure between the two triangular elements, to which the L-shaped element is attached.

The L-shaped element is moved up and down into the up position and down position via a hydraulic element at the pivot point 208. The hydraulic element at the pivot point 208 moves the L-shaped element to pivot or rotate around the pivot point. This action rotates the L-shaped element substantially 90 to 180 degrees into the up position, so as to turn the garbage bins 802, 804 substantially upside down or nearly upside down. The opposite action rotates the L-shaped element substantially 90 to 180 degrees into the down position, so as to turn the garbage bins 802, 804 substantially right side up.

The vehicle-mounted garbage bin cleaning system 200 further comprises a hopper 204 configured for accepting garbage bins when the pairs of arms lift the garbage bins into the hopper. The vehicle-mounted garbage bin cleaning system 200 further comprises two pairs of arms 231, 232, each pair of arms is configured to allow for garbage bins to be raised and lifted into the hopper for pressure cleaning at the same time.

FIG. 4 also shows at least two spray rods 302, 304 extending upwards from the hopper 204, each spray rod including at least one high-pressure, rotating water nozzle 312, 314 that sprays a water jet. In another embodiment, each spray rod includes a plurality of high-pressure, rotating water nozzles that spray water jets.

Figure 9:
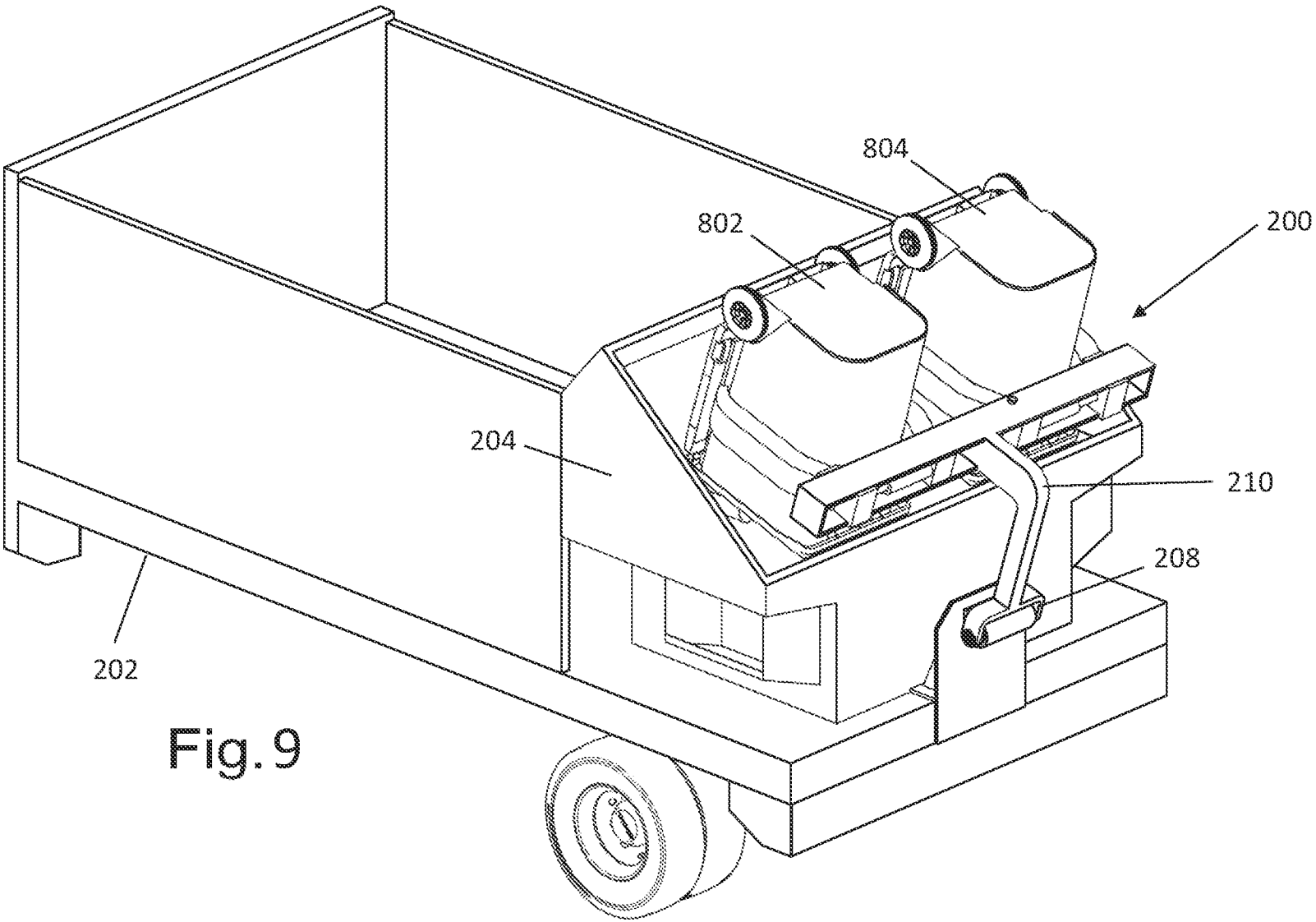
FIG. 9 is a drawing depicting a top perspective view of the vehicle-mounted garbage bin cleaning system of FIG. 2, showing two pairs of arms in the up position and lifting bins into the hopper, according to an example embodiment.

The hopper is configured to catch substantially all water that is sprayed into the garbage bins by the at least two spray rods. FIG. 9 also shows that when the pairs of arms 231, 232 lift the garbage bins into the hopper, one or more of the at least two spray rods may be situated within the garbage bins (or near the opening of the garbage bins) so as to wash and clean the interior thereof with the corresponding rotating water nozzles 312, 314 that spray water jets.

Figure 5:
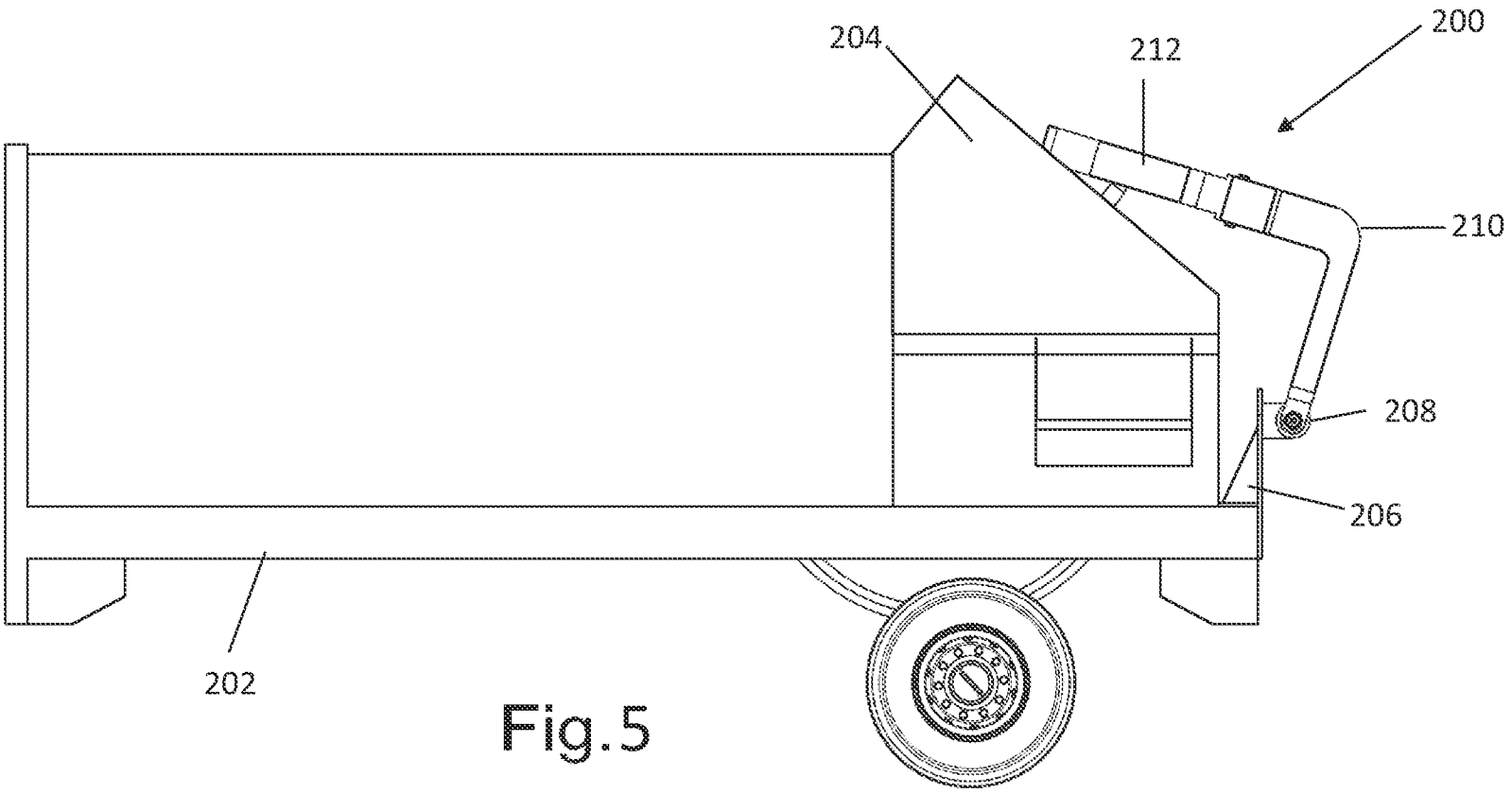
FIG. 5 is a drawing depicting a side view of the vehicle-mounted garbage bin cleaning system including power takeoff of FIG. 2, showing two pairs of arms in the up position, according to an example embodiment.
Figure 6:
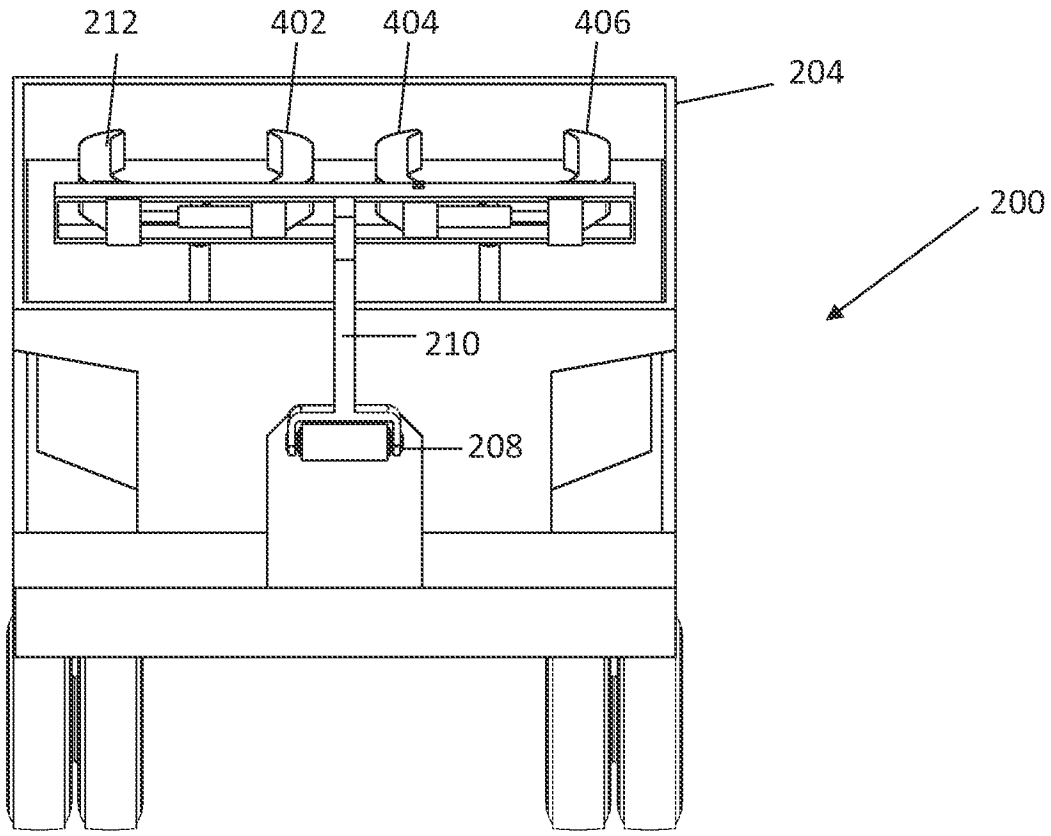
FIG. 6 is a drawing depicting a rear view of the vehicle-mounted garbage bin cleaning system including power takeoff of FIG. 2, showing two pairs of arms in the up position, according to an example embodiment.
Figure 7:
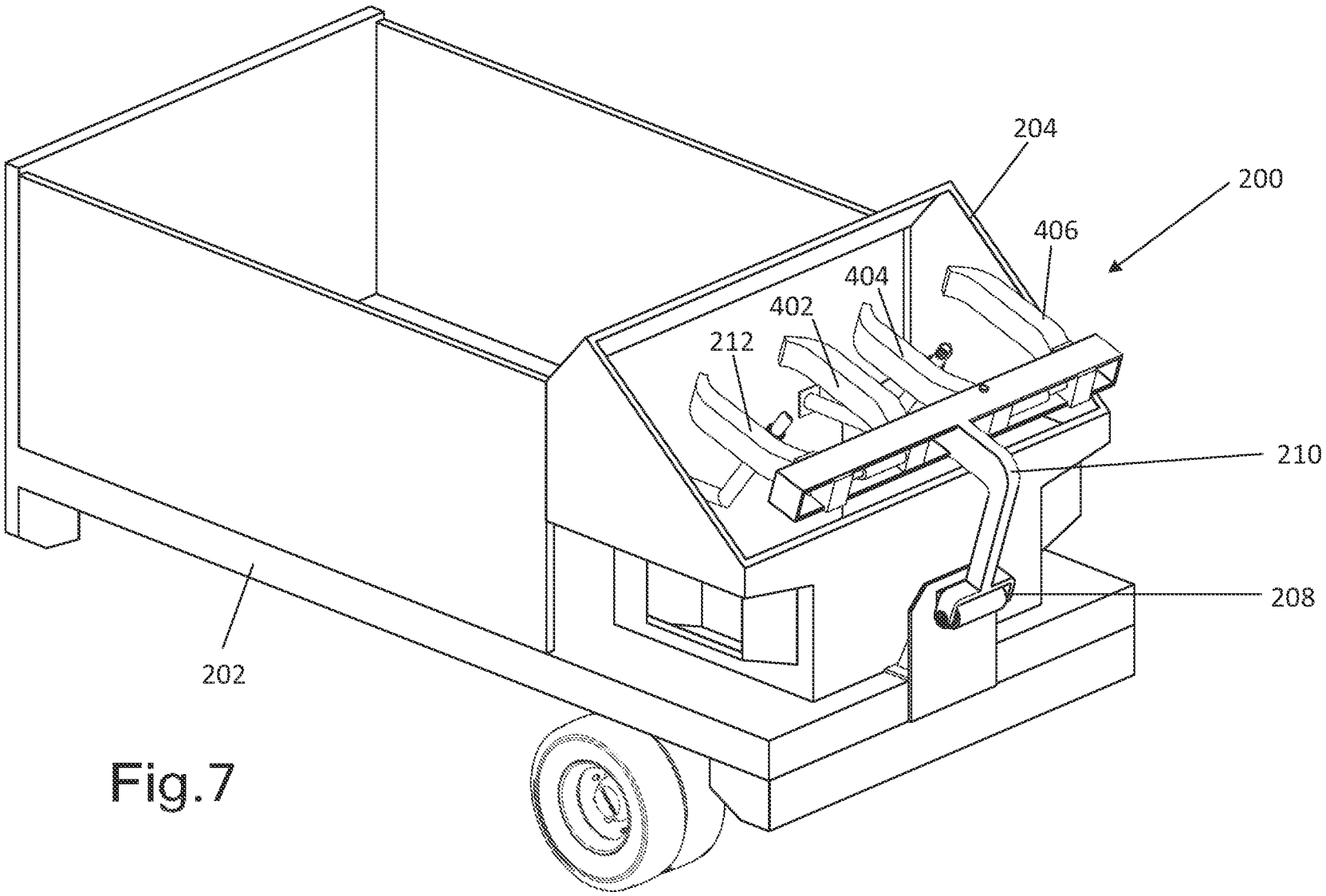
FIG. 7 is a drawing depicting a to perspective view of the vehicle-mounted garbage bin cleaning system including power takeoff of FIG. 2, showing two pairs of arms in the up position, according to an example embodiment.

FIG. 5 is a drawing depicting a side view of the vehicle-mounted garbage bin cleaning system 200 including power takeoff of FIG. 2, showing two pairs of arms 231, 232 in the up position, according to an example embodiment. FIG. 6 depicts a rear view of the vehicle-mounted garbage bin cleaning system 200 of FIG. 5, and FIG. 7 depicts a top perspective view of the vehicle-mounted garbage bin cleaning system 200 of FIG. 5. FIGS. 5-7 show that the vehicle-mounted garbage bin cleaning system 200 including power takeoff is configured such that the two pairs of arms 231, 232 can be lifted into the up position such that bins may be moved into the hopper for cleaning. Though the first pair of arms 231 and the second pair of arms 232 are shown both moving to the up position simultaneously at the same time, they are also configured to move independently from one another, such that one pair of arms may be activated without activating the other pair. FIGS. 6-7 further show that when the first pair of arms 231 and the second pair of arms 232 are moved to the up position, the spray heads 312, 314 are located centrally within the space between each pair of arms. That is, each spray head is located in between a pair of arms, thereby being ideally located for optimal cleaning of the bins by the spray heads.

Figure 8:
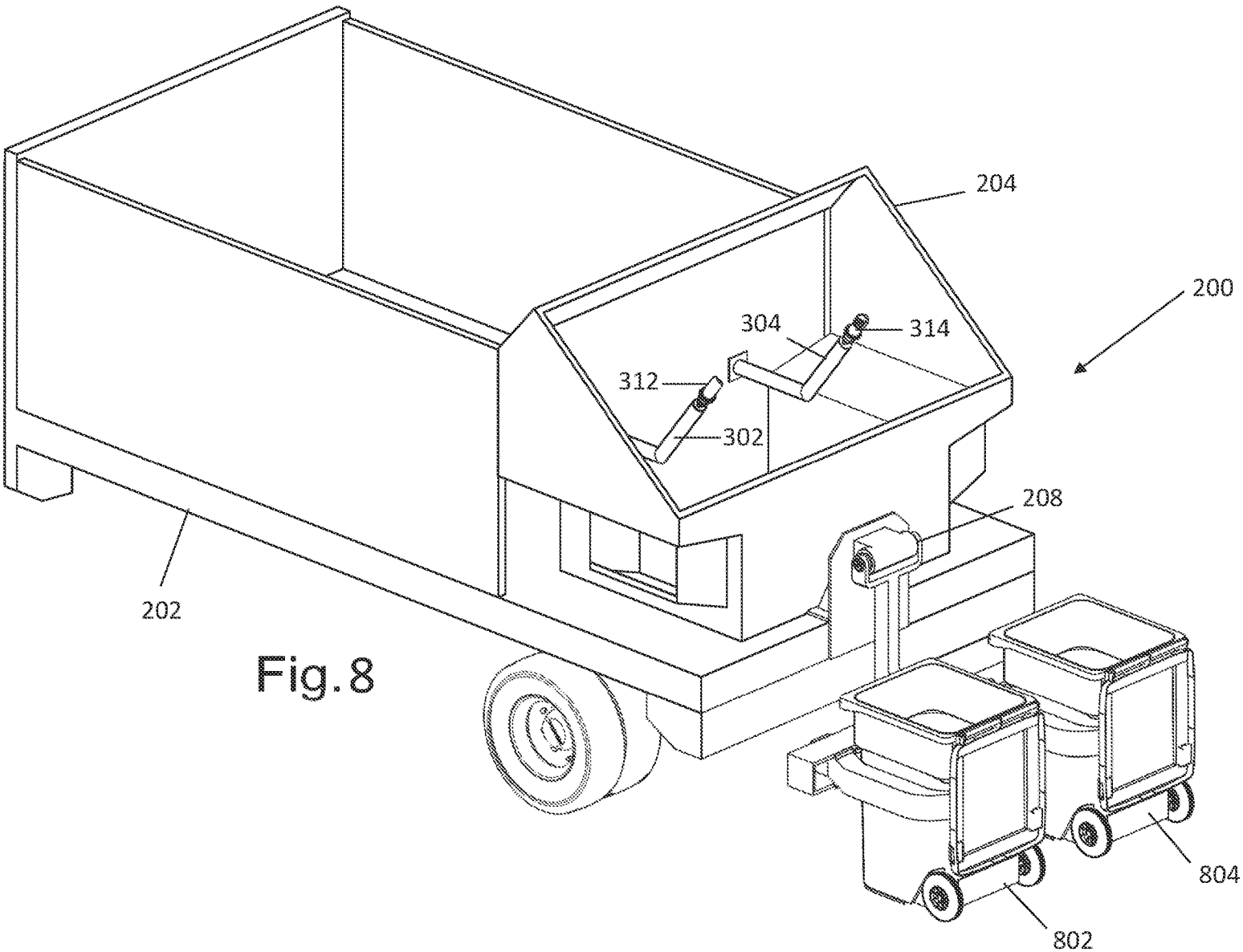
FIG. 8 is a drawing depicting a top perspective view of the vehicle-mounted garbage bin cleaning system of FIG. 2, showing the two pairs of arms in the down position, wherein each pair of arms is grabbing a bin, according to an example embodiment.

FIG. 8 is a drawing depicting a top perspective view of the vehicle-mounted garbage bin cleaning system 200 of FIG. 2, showing the two pairs of arms 231, 232 in the down position, wherein each pair of arms is grabbing a bin, according to an example embodiment. FIG. 8 shows that the first pair of arms 231 has grabbed the bin 802 and the second pair of arms 232 has grabbed the bin 804, while both pairs of arms are in the down position. The first pair of arms 231 may grab the bin 802 and the second pair of arms 232 may grab the bin 804 simultaneously, or each bin may be grabbed at a different time. Next, the first pair of arms 231 and the second pair of arms 232 will be moved to the up position to clean the bins 802, 804.

FIG. 9 is a drawing depicting a top perspective view of the vehicle-mounted garbage bin cleaning system 200 of FIG. 2, showing two pairs of arms 231, 232 in the up position and lifting bins 802, 804 into the hopper 204, according to an example embodiment. FIG. 9 shows that the first pair of arms 231 has grabbed the bin 802 and the second pair of arms 232 has grabbed the bin 804, and both pairs of arms have been moved to the up position, thereby moving the bins 802, 804 into the hopper for the purpose of cleaning the bins using the spray heads 312, 314 located within the hopper 204. Note that in the up position, each of the spray heads 312, 314 is located centrally within one of the bins 802, 804, thereby being ideally located for optimal cleaning of the bins. The bins 802, 804 may be moved to the up position by the two pairs of arms 231, 232 simultaneously, or each bin may be moved to the up position at different times, since the two pairs of arms 231, 232 may move independently of each other.

Figure 10:
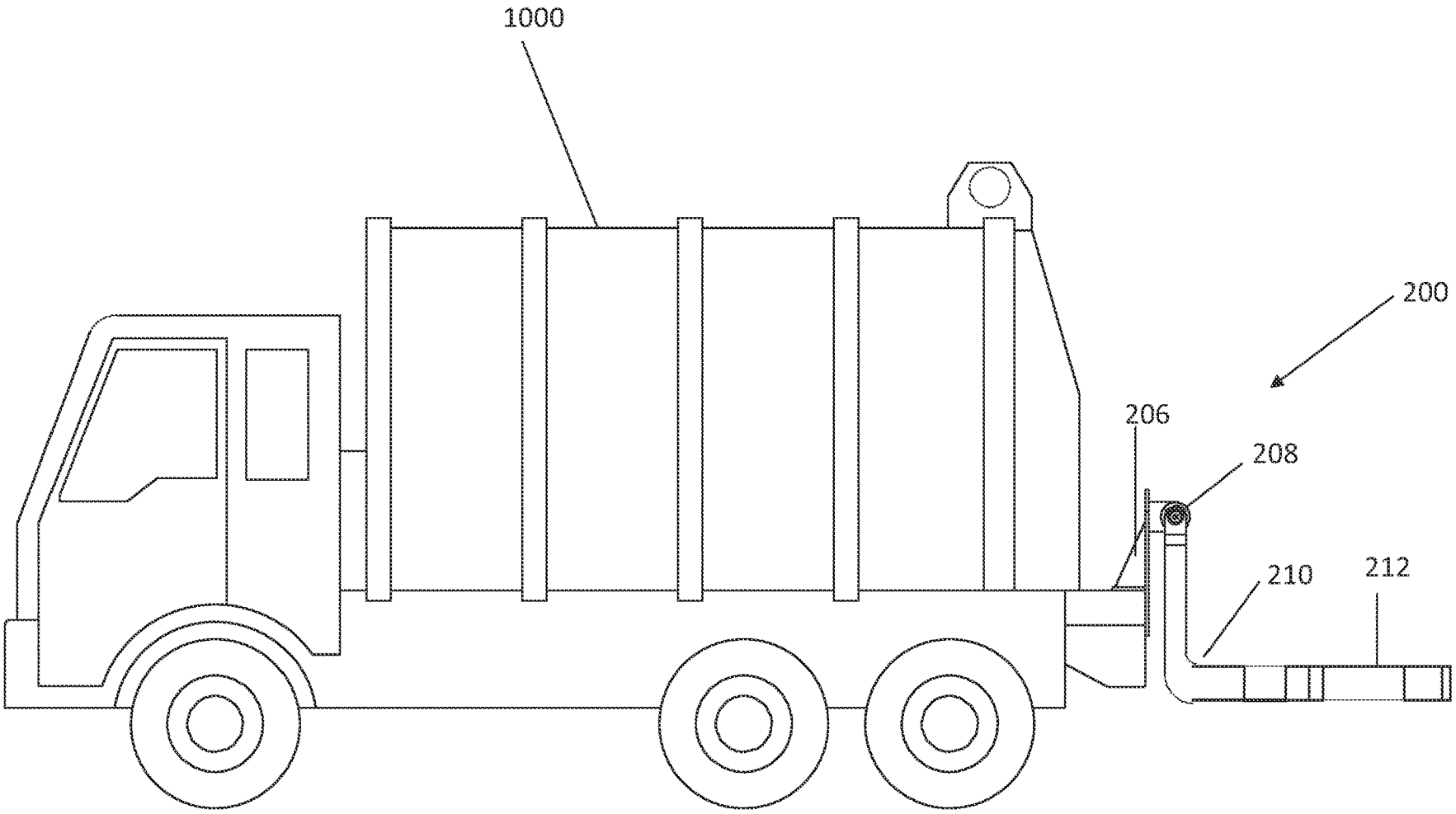
FIG. 10 is a drawing depicting a side view of the vehicle-mounted garbage bin cleaning system of FIG. 2, including an attached vehicle, showing two pairs of arms in the down position, according to an example embodiment.

FIG. 10 is a drawing depicting a side view of the vehicle-mounted garbage bin cleaning system 200 of FIG. 2, including an attached vehicle 1000, showing two pairs of arms 231, 232 in the down position, according to an example embodiment. The vehicle-mounted garbage bin cleaning system 200 may be coupled to the trailer 202 of the vehicle 1000, such as an industrial truck.

In one embodiment, the vehicle-mounted garbage bin cleaning system 200 may further include an electrically activated system configured for spraying a liquid disinfectant into the garbage bins 802, 804 when the garbage bin are in the hopper 204. Disinfectants are antimicrobial agents that are applied to the interior of garbage bins to destroy microorganisms that are living in the garbage bins.

In another embodiment, the vehicle-mounted garbage bin cleaning system 200 may further include a control panel for controlling the two pairs of arms 231, 232, the water jets sprayed by the at least two spray rods 302, 304. The control panel may be a flat and/or vertical area where control or monitoring instruments are displayed and located in an area that users can access. The control panel may be equipped with push buttons and analog instruments, or, alternatively, touchscreens, used for monitoring and control purposes. A user can utilize the control panel to control the up and down positions of the two pairs of arms 231, 232, whether and when the water jets are sprayed by the at least two spray rods, when the bins are in the optimal location within the hopper, for optimal cleaning effect.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A vehicle-mounted garbage bin cleaning system including power takeoff, the system comprising:

a) a first pair of arms configured for lifting a first garbage bin, the first pair of arms rotatably coupled to a mount on a vehicle, and a second pair of arms configured for lifting a second garbage bin simultaneously with the first pair of arms, the second pair of arms rotatably coupled to the mount on the vehicle;

b) a hopper configured for accepting the first and second garbage bins when the first and second pair of arms simultaneously lift the first and second garbage bins into the hopper;

c) at least two spray rods extending upwards from the hopper, each of the at least two spray rods including at least one high-pressure, rotating water nozzle that sprays a water jet;

d) wherein when the first and second pair of arms simultaneously lift the first and second garbage bin into the hopper, a first of the at least two spray rods is situated within the first garbage bin and a second of the at least two spray rods is situated within the second garbage bin; and e) a power takeoff driven pressure washing system comprising:

1) a first hydraulic pump mechanically coupled with a transmission of the vehicle, such that the transmission drives the first hydraulic pump;

2) a first pressure washer pump hydraulically coupled to the first hydraulic pump such that the first hydraulic pump drives the first pressure washer pump, and a second pressure washer pump hydraulically coupled to the first hydraulic pump such that the first hydraulic pump drives the second pressure washer pump; and 3) wherein the first of the at least two spray rods is fluidically coupled with the first pressure washer pump such that first pressure washer pump provides pressurized water to the first of the at least two spray rods, and the second of the at least two spray rods is fluidically coupled with the second pressure washer pump such that second pressure washer pump provides pressurized water to the second of the at least two spray rods.

2. The vehicle-mounted garbage bin cleaning system of claim 1, wherein the power takeoff driven pressure washing system comprises an open loop hydraulic system.

3. The vehicle-mounted garbage bin cleaning system of claim 2, wherein the power takeoff driven pressure washing system further comprises a hydraulic tank that feeds hydraulic fluid to the first hydraulic pump.

4. The vehicle-mounted garbage bin cleaning system of claim 3, wherein the power takeoff driven pressure washing system further comprises a hydraulic directional control valve coupled to the first hydraulic pump and the first and second pressure washer pumps, so as to control the direction of hydraulic fluid through the first and second pressure washer pumps.

5. The vehicle-mounted garbage bin cleaning system of claim 1, wherein the hopper is configured to catch substantially all water that is sprayed by the at least two spray rods.

6. The vehicle-mounted garbage bin cleaning system of claim 5, further comprising a water tank that provides a source of water to the first and second pressure washer pumps.

7. The vehicle-mounted garbage bin cleaning system of claim 6, further comprising a control panel for controlling the first and second pair of arms, and the water jets sprayed by the at least two spray rods.

8. A vehicle-mounted garbage bin cleaning system including power takeoff, the system comprising:

a) a first pair of arms configured for lifting a first garbage bin, the first pair of arms rotatably coupled to a vehicle, and a second pair of arms configured for lifting a second garbage bin simultaneously with the first pair of arms, the second pair of arms rotatably coupled to the vehicle;

b) a hopper configured for accepting the first and second garbage bins when the first and second pair of arms simultaneously lift the first and second garbage bins into the hopper;

c) at least two spray rods extending upwards from the hopper, each of the at least two spray rods including at least one high-pressure, rotating water nozzle that sprays a water jet;

d) wherein when the first and second pair of arms simultaneously lift the first and second garbage bin into the hopper, the at least two spray rods are configured to move such that a first of the at least two spray rods is situated within the first garbage bin and a second of the at least two spray rods is situated within the second garbage bin; and e) a power takeoff driven pressure washing system comprising:

1) a first hydraulic pump mechanically coupled with a transmission of the vehicle, such that the transmission drives the first hydraulic pump;

2) a first pressure washer pump hydraulically coupled to the first hydraulic pump such that the first hydraulic pump drives the first pressure washer pump, and a second pressure washer pump hydraulically coupled to the first hydraulic pump such that the first hydraulic pump drives the second pressure washer pump; and 3) wherein the first of the at least two spray rods is fluidically coupled with the first pressure washer pump such that first pressure washer pump provides pressurized water to the first of the at least two spray rods, and the second of the at least two spray rods is fluidically coupled with the second pressure washer pump such that second pressure washer pump provides pressurized water to the second of the at least two spray rods.

9. The vehicle-mounted garbage bin cleaning system of claim 8, wherein the power takeoff driven pressure washing system comprises an open loop hydraulic system.

10. The vehicle-mounted garbage bin cleaning system of claim 9, wherein the power takeoff driven pressure washing system further comprises a hydraulic tank that feeds hydraulic fluid to the first hydraulic pump.

11. The vehicle-mounted garbage bin cleaning system of claim 10, wherein the power takeoff driven pressure washing system further comprises a first hydraulic directional control valve coupled to the first hydraulic pump and the first pressure washer pump, so as to control the direction of hydraulic fluid through the first pressure washer pump, and wherein the power takeoff pressure washing system further comprises a second hydraulic directional control valve coupled to the first hydraulic pump and the second pressure washer pump, so as to control the direction of hydraulic fluid through the second pressure washer pump.

12. The vehicle-mounted garbage bin cleaning system of claim 8, wherein the hopper is configured to catch substantially all water that is sprayed by the at least two spray rods.

13. The vehicle-mounted garbage bin cleaning system of claim 12, wherein each of the at least two spray rods include a plurality of high-pressure, rotating water nozzles that spray water jets.

14. The vehicle-mounted garbage bin cleaning system of claim 13, further comprising a water tank that provides a source of water to the first and second pressure washer pumps.

15. The vehicle-mounted garbage bin cleaning system of claim 14, further comprising a control panel for controlling a pair of arms, and the water jets sprayed by the at least two spray rods.

16. A vehicle-mounted garbage bin cleaning system including power takeoff, the system comprising:

a) a first pair of arms configured for lifting a first garbage bin, the first pair of arms rotatably coupled to a mount on a vehicle, and a second pair of arms configured for lifting a second garbage bin simultaneously with the first pair of arms, the second pair of arms rotatably coupled to the mount on the vehicle;

b) a hopper configured for accepting the first and second garbage bins when the first and second pair of arms simultaneously lift the first and second garbage bins into the hopper;

c) at least two spray rods movably mounted to a beam in the hopper, each of the at least two spray rods including at least one high-pressure, rotating water nozzle that sprays a water jet;

d) wherein when the first and second pair of arms simultaneously lift the first and second garbage bin into the hopper, a first of the at least two spray rods is situated within the first garbage bin and a second of the at least two spray rods is situated within the second garbage bin; and e) a power takeoff driven pressure washing system comprising:

1) a first hydraulic pump mechanically coupled with a transmission of the vehicle, such that the transmission drives the first hydraulic pump;

2) a first pressure washer pump hydraulically coupled to the first hydraulic pump such that the first hydraulic pump drives the first pressure washer pump, and a second pressure washer pump hydraulically coupled to the first hydraulic pump such that the first hydraulic pump drives the second pressure washer pump; and 3) wherein the first of the at least two spray rods is fluidically coupled with the first pressure washer pump such that first pressure washer pump provides pressurized water to the first of the at least two spray rods, and the second of the at least two spray rods is fluidically coupled with the second pressure washer pump such that second pressure washer pump provides pressurized water to the second of the at least two spray rods.

17. The vehicle-mounted garbage bin cleaning system of claim 16, wherein the power takeoff pressure washing system comprises an open loop hydraulic system.

18. The vehicle-mounted garbage bin cleaning system of claim 17, wherein the power takeoff pressure washing system further comprises a hydraulic tank that feeds hydraulic fluid to the first hydraulic pump.

* * * * *